US010391538B2

(12) United States Patent
Jirková et al.

(10) Patent No.: US 10,391,538 B2
(45) Date of Patent: Aug. 27, 2019

(54) METHOD OF MANUFACTURING HOT DEEP DRAWN STEEL PARTS OF SHEET METAL

(71) Applicant: Západočeská univerzita v Plzni, Plzeň (CZ)

(72) Inventors: Hana Jirková, Plzeň (CZ); Bohuslav Mašek, Kaznějov (CZ)

(73) Assignee: Zapadoceska Univerzita V Plzni, Plzen (CZ)

( * ) Notice: Subject to any disclaimer, the term of this patent is extended or adjusted under 35 U.S.C. 154(b) by 1055 days.

(21) Appl. No.: 14/753,972

(22) Filed: Jun. 29, 2015

(65) Prior Publication Data

US 2015/0375286 A1 Dec. 31, 2015

(30) Foreign Application Priority Data

Jun. 30, 2014 (CZ) ..... 2014-455

(51) Int. Cl.

| | |
|---|---|
| ***B21D 22/02*** | (2006.01) |
| ***B21D 22/20*** | (2006.01) |
| ***B21D 26/021*** | (2011.01) |
| ***B21D 26/033*** | (2011.01) |
| ***B21C 47/26*** | (2006.01) |
| ***B21B 1/088*** | (2006.01) |
| ***C21D 7/13*** | (2006.01) |
| ***C21D 1/673*** | (2006.01) |

(52) U.S. Cl.

CPC ..... *B21D 22/208* (2013.01); *B21B 1/088* (2013.01); *B21C 47/262* (2013.01); *B21D 22/201* (2013.01); *B21D 26/021* (2013.01); *B21D 26/033* (2013.01); *C21D 1/673* (2013.01); *C21D 7/13* (2013.01)

(58) Field of Classification Search

CPC .. B21D 22/022; B21D 26/021; B21D 26/033; B21D 22/208; B21D 22/201; C21D 1/673; C21D 7/13; B21B 1/088; B21C 47/262

USPC ..... 72/342.6

See application file for complete search history.

(56) References Cited

U.S. PATENT DOCUMENTS

| | | | | | |
|---|---|---|---|---|---|
| 4,054,276 | A * | 10/1977 | Wilson | B21C 47/262 | 140/2 |
| 4,122,700 | A * | 10/1978 | Granzow | B21D 22/02 | 72/342.3 |
| 4,619,714 | A * | 10/1986 | Thomas | C21D 8/0226 | 148/320 |
| 5,966,977 | A * | 10/1999 | Engel | B21B 1/088 | 72/201 |
| 7,024,897 | B2 * | 4/2006 | Pfaffmann | B21D 26/033 | 148/520 |
| 8,646,302 | B2 * | 2/2014 | Lety | B21D 22/022 | 72/342.7 |
| 2011/0239721 | A1 * | 10/2011 | Carter | B21D 26/021 | 72/60 |
| 2015/0336151 | A1 * | 11/2015 | Frost | B21D 22/022 | 72/352 |

* cited by examiner

*Primary Examiner* — David B Jones

(74) *Attorney, Agent, or Firm* — Hovey Williams LLP

(57) ABSTRACT

The invention relates to a method of manufacturing steel parts of sheet metal by hot deep drawing characterized by bringing the semi-finished product into austenitic condition by heating, subsequently cooling its locations, which would undergo undesirable deformation, to a temperature below the austenite temperature, and then completing the forming process.

3 Claims, No Drawings

METHOD OF MANUFACTURING HOT DEEP DRAWN STEEL PARTS OF SHEET METAL

RELATED APPLICATION

This application claims the benefit of Czech Republic Application No. PV2014-455 filed Jun. 30, 2014, the entire disclosure of which is incorporated herein by reference.

FIELD OF THE INVENTION

This invention relates to a method of manufacturing steel parts of sheet by hot deep drawing.

PRIOR ART

At present, hot-formed steel parts made by deep drawing and subsequent cooling in the tool are made by heating a sheet metal blank of suitable dimensions in a furnace to the austenite temperature, holding for several minutes, then removing the sheet metal blank from the furnace and transferring it to a tool, in which deep drawing is carried out. This pressed part cools when it comes into contact with the tool, which causes transformation to a microstructure, which is typically or hardening type, i.e. martensite, bainite or mixed-type. This method is used, for instance, in the U.S. Pat. No. 4,619,714. This manufacturing method allows three-dimensional shapes to be made which are limited by the material's plasticity and ductility at the temperature which affects the moment, at which the material fails. The shapes of the three-dimensional portions of the drawn part are often very complex and the shortage of material in the severely-formed zones causes the wall thickness in some locations to decrease disproportionately, which in turn leads to localized deformation, which results in failure. This makes the manufacture of drawn parts with larger depths impossible. A typical failure is a radial crack in the fins, which initiates below the transition area between the flat portion of the pressed part and the wall. In practice, this drawback is eliminated by cold pre-drawing the semi-finished product and by subsequent completion of the final shape by hot drawing. However, as no heating is used in the first cold forming operation, the diffusion, which is necessary for the corrosion-resistant film to adequately bond to the sheet metal, does not take place. Due to its insufficient plasticity at room temperature, the film then suffers damage during deformation and peels off the final drawn part. Aside from that, this multiple drawing process is lengthy, requires more complex logistics and costly multistage forming tools. It also requires longer machine times and higher energy consumption.

SUMMARY OF THE INVENTION

The aforementioned drawback of formed parts of sheet metal by a hot process is eliminated by a method of manufacturing characterized in that a steel sheet metal blank heated in a furnace to austenite temperature is locally cooled either while being transferred to a forming tool or before the forming tool closes or at the moment the forming tool closes. This local cooling is applied to areas where problems occur with a shortage of material and with deformation localization and where excessive reduction of area leads to crack initiation in the real-life three-dimensional drawn part. This cooling may be achieved, for instance, by the application of a stream of gas, gas-liquid mixture, liquid, or by contact with another material capable of conducting the heat away, or by other methods. The cooling may be carried out at a pre-defined cooling rate in order to achieve the best possible effect with regard to the required shape of the drawn part. Local cooling of the material in pre-defined areas will increase flow stress, which will prevent deformation localization in this particular location, and the deformation will thus move to other areas or spread across a larger area in order to prevent failure of the material and the resulting crack formation in the drawn part due to high local reduction of area. This cooling may be carried out either to the undercooled austenite region or even to the region of mixed microstructures consisting of austenite, martensite, bainite, ferrite.

EXAMPLE EMBODIMENT

A blank of sheet metal of 1.5 mm thickness of the 22MnB5 steel is heated in a furnace to the temperature of 950° C., at which it is kept in the furnace for the period of 3 minutes. This brings it into fully austenitic condition. After that, it is removed from the furnace and transferred to a tool. Before it is placed into the tool, the transfer is interrupted for approximately 1 second, during which nozzles located above the sheet metal blank blow pressurized mixture of air and water in a controlled manner onto selected locations of the sheet metal blank. This local cooling reduces the temperature in the desired locations down to 500° C. By this means, areas with higher flow stress are created. The plasticity of the material distributed differentially across the semi-finished product in this manner leads to the creation of the desired profile of deformation properties in the particular sheet metal blank. After this, the transfer of the sheet metal blank to the tool is completed. In the tool, the blank is formed in a deep-drawing operation. This entire transfer of the sheet metal blank from the furnace to the tool, including the local cooling, takes approximately 10 seconds. After the deformation, the semi-finished product remains enclosed in the tool for additional 15 seconds in order for the desired hardening-type microstructure to form. By this means, the temperature of the drawn part decreases to less than 150° C. At the same time, the microstructure evolution is thus completed. After that, the pressed part is removed from the mold and cools to the ambient temperature on transport equipment.

INDUSTRIAL APPLICABILITY

The invention can find broad use in the field of sheet metal processing in hot deep drawing applications, predominantly in the manufacture of complex-shaped parts with a large depth of the final shape, which are impossible to make using the conventional route in a single draw.

The invention claimed is:

1. A hot deep drawing method of manufacturing steel parts comprising:

(a) heating a sheet metal blank to bring the sheet metal blank into austenitic condition;

(b) subsequently cooling critical-deformation locations of the sheet metal blank to a temperature below an austenite temperature, wherein the critical-deformation locations comprise undercooled austenite regions of the sheet metal blank and/or regions of mixed microstructures; and (c) subjecting the sheet metal blank to a forming process comprising a forming tool.

2. The method of manufacturing steel parts as claimed in claim 1 wherein the cooling of the critical-deformation locations of the sheet metal blank occurs after the sheet metal blank was heated to the austenitic condition and before the sheet metal blank is placed into the forming tool.

3. The method of manufacturing steel parts as claimed in claim 1 further comprising cooling the sheet metal blank after the heating of step (a) and after placing the sheet metal blank into the forming tool.

* * * * *